US009264159B2

(12) United States Patent
Moskowitz et al.

(10) Patent No.: US 9,264,159 B2
(45) Date of Patent: Feb. 16, 2016

(54) DISTRIBUTED CONTRIBUTION OF DISPARATE INTERACTIVE ELEMENTS

(75) Inventors: Alan Moskowitz, Oakland, CA (US); Daniel Dennedy, Castro Valley, CA (US); Do H. Chung, San Ramon, CA (US)

(73) Assignee: MobiTV, Inc., Emeryville, CA (US)

( * ) Notice: Subject to any disclaimer, the term of this patent is extended or adjusted under 35 U.S.C. 154(b) by 319 days.

(21) Appl. No.: 12/635,574

(22) Filed: Dec. 10, 2009

(65) Prior Publication Data

US 2011/0145848 A1 Jun. 16, 2011

(51) Int. Cl.

| | |
|---|---|
| ***H04H 60/33*** | (2008.01) |
| *H04H 60/85* | (2008.01) |
| *H04H 60/91* | (2008.01) |

(52) U.S. Cl.
CPC ..... *H04H 60/33* (2013.01); *H04H 60/85* (2013.01); *H04H 60/91* (2013.01)

(58) Field of Classification Search
CPC ..... H04N 21/25891; H04N 21/44222
USPC ..... 725/13, 62, 94, 86, 112, 44
See application file for complete search history.

(56) References Cited

U.S. PATENT DOCUMENTS

| | | | | |
|---|---|---|---|---|
| 5,317,391 | A | 5/1994 | Banker et al. | |
| 5,850,218 | A | 12/1998 | LaJoie et al. | |
| 6,516,191 | B1 | 2/2003 | Greenspan et al. | |
| 2002/0077880 | A1 | 6/2002 | Gordon et al. | |
| 2003/0093792 | A1 | 5/2003 | Labeeb et al. | |
| 2004/0025178 | A1 | 2/2004 | Gordon et al. | |
| 2004/0031058 | A1* | 2/2004 | Reisman | 725/112 |
| 2007/0018952 | A1* | 1/2007 | Arseneau et al. | 345/156 |
| 2007/0061487 | A1 | 3/2007 | Moore et al. | |
| 2008/0065507 | A1 | 3/2008 | Morrison et al. | |
| 2008/0151888 | A1 | 6/2008 | Ahmed | |
| 2008/0160964 | A1 | 7/2008 | Lichtenfeld et al. | |
| 2009/0028081 | A1 | 1/2009 | Song et al. | |
| 2009/0177528 | A1* | 7/2009 | Wu et al. | 705/10 |
| 2009/0183204 | A1* | 7/2009 | White | 725/44 |
| 2009/0216606 | A1 | 8/2009 | Coffman et al. | |
| 2009/0231189 | A1 | 9/2009 | Reddy et al. | |
| 2009/0254424 | A1 | 10/2009 | Swanson | |
| 2010/0125491 | A1* | 5/2010 | Elliott et al. | 705/14.4 |
| 2011/0082807 | A1* | 4/2011 | Parekh et al. | 705/319 |

OTHER PUBLICATIONS

"Using the P5 Application Framework for Audience Measurement", Alan Moskowitz, Jun. 10, 2008.

(Continued)

*Primary Examiner* — Jivka Rabovianski
(74) *Attorney, Agent, or Firm* — Kwan & Olynick LLP

(57) ABSTRACT

Mechanisms are provided for collecting user response information corresponding to a request transmitted as a part of unidirectional media broadcast. Mobile devices used to display media broadcast containing the request, such a survey, are also configured to send information using other communication networks, such as cellular networks. Mobile devices collect users' responses to the request and send information corresponding to these responses to a response processing server. The response processing server in turn processes the information, generate a report, and transmit this report to the broadcasting service. These reports may be used for a variety of purposes. In one example, reports are used to update broadcasted content such that mobile device user can view results of their responses as a part of the updated broadcast.

21 Claims, 6 Drawing Sheets

(56) References Cited

OTHER PUBLICATIONS

Moskowitz et al., "Data Measurement and Feedback Mechanism Using an Application Framework", U.S. Appl. No. 12/651,117, filed Dec. 31, 2009.

WO patent application No. PCT/US2010/059557, International Search Report and Written Opinion mailed Feb. 1, 2011.

WO patent application No. PCT/US10/59576, International Search Report and Written Opinion mailed Feb. 2, 2011.

"United Kingdom Application Serial No. 1208776.3, Office Action mailed Mar. 11, 2015".

* cited by examiner

DISTRIBUTED CONTRIBUTION OF DISPARATE INTERACTIVE ELEMENTS

BACKGROUND

It is often desirable to update media broadcast devices based on the information provided by the broadcast viewers in order to make the media broadcast more interactive. For example, a TV program may include a poll asking the viewers to provide their responses. The viewers are also provided with instructions on responding to a poll, which usually involves making a phone call, sending a text message or an e-mail, or other ways that involve using another device capable of sending information back to the broadcasting service. A need to use separate devices or interfaces adds complexity to the overall process and tends to discourage viewers from responding to requests, such as surveys, sent to their devices. Further, this complexity slows the overall response process making it difficult to implement in a real-time interactive environment. Consequently, the techniques and mechanisms of the present invention provide improved mechanisms for collecting user responses and updating media broadcast based on information provided by the viewers.

OVERVIEW

Mechanisms and techniques are provided for collecting viewers' responses that correspond to a request transmitted to the user devices as a part of the media broadcast. According to particular embodiments, the same user devices are capable of receiving broadcasting signals and transmitting responses to the request through various networks, one of which may be a cellular network. Such mechanism and techniques also include processing the responses to generate a report and transmitting the report to a broadcasting service. The broadcasting service, in turn, may use the information contained in the report to update its broadcasted content transmitted to various user devices.

Certain aspects of the present invention may be better explained by a way of a specific example. For example, a broadcasting service may transmit a signal containing a video stream on one of the channels. User devices that are tuned to this channel display the stream on their devices. The broadcasting service may then incorporate a request, such as a survey, into the channel content, e.g., asking a question about viewer's opinion of the video clip. The viewers may then use user device interfaces to respond to the request (e.g., select various options listed on the screen as a part of the survey) and responses are transmitted to the response processing server. For example, the responses may be sent through a network, such as a wireless broadband network or a wired network. The server then aggregates and processes the responses based on a predetermined set of criteria (e.g., performing a statistical analysis, limiting a number of responses to a specific time frame, etc.). In particular embodiments, the server also generates a report based on these responses and transmits the report to the broadcasting service, which in turn uses the report to include response results into the broadcast (e.g., survey results, such as listing a percentage of viewers who enjoyed this video clip) or to modify their own broadcasts.

These and other features of the present invention will be presented in more detail in the following specification of the invention and the accompanying figures, which illustrate by way of example the principles of the invention.

BRIEF DESCRIPTION OF THE DRAWINGS

The disclosure may best be understood by reference to the following description taken in conjunction with the accompanying drawings, which illustrates particular embodiments of the present invention.

DESCRIPTION OF PARTICULAR EMBODIMENTS

Figure 1:
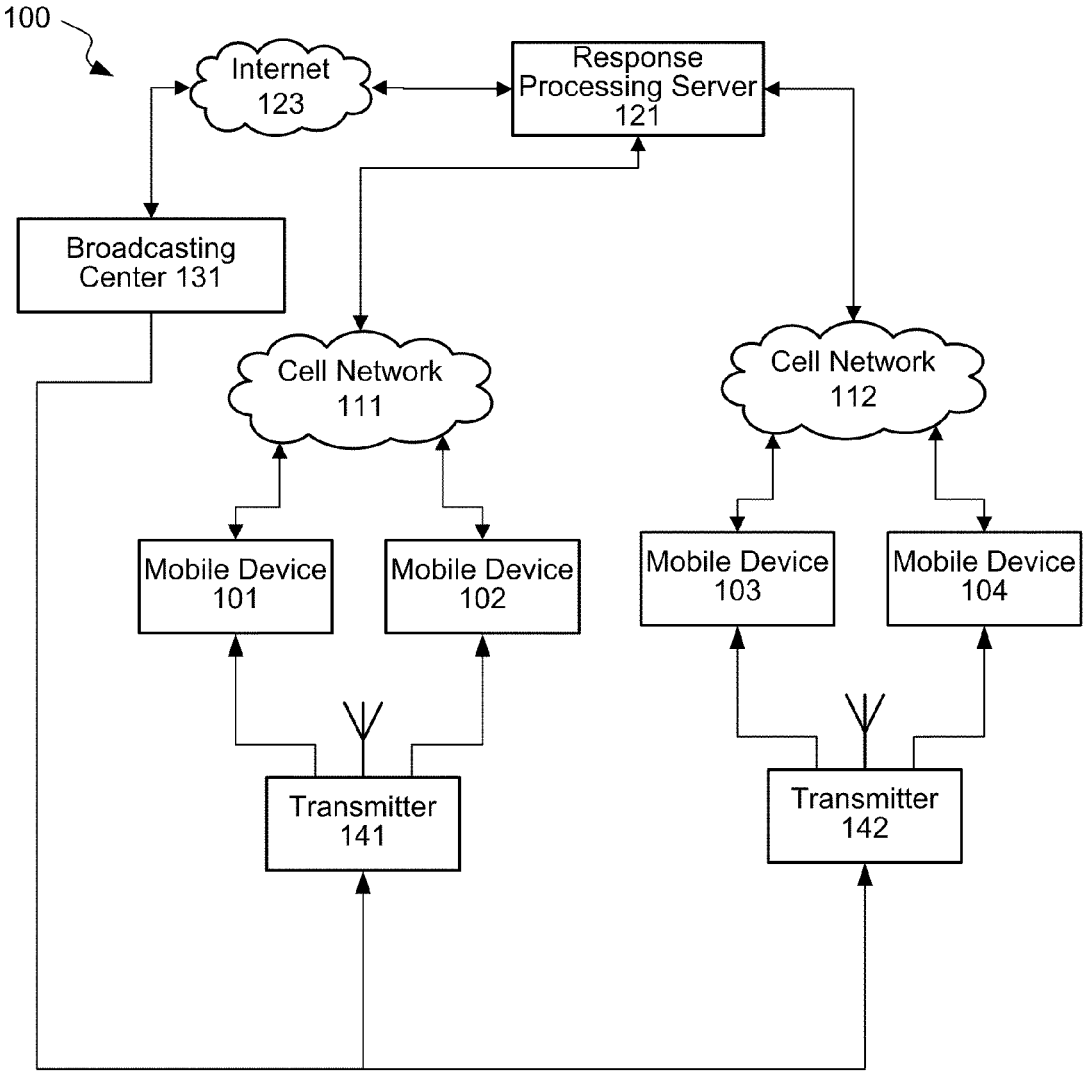
FIG. 1 illustrates a particular example of a network that can use the techniques and mechanisms of the present invention.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

For example, the techniques of the present invention will be described in the context of particular user devices, such as mobile devices. However, it should be noted that the techniques and mechanisms of the present invention can be used with a variety of devices including general computing devices. In the following description, numerous specific details are set forth in order to provide a thorough understanding of the present invention. The present invention may be practiced without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a processor is used in a variety of contexts. However, it will be appreciated that multiple processors can also be used while remaining within the scope of the present invention unless otherwise noted. Furthermore, the techniques and mechanisms of the present invention will sometimes describe two entities as being connected. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, a connection does not necessarily mean a direct, unimpeded connection unless otherwise noted.

The techniques and mechanisms of the present invention recognize that receiving responses to a media broadcast and/or updating a media broadcast could be valuable. Conventional media broadcasts, such as an over the air television broadcast, in real time based on responses received from the viewers are unidirectional. That is, devices are typically only capable of receiving transmissions and have very limited mechanisms available for providing feedback to media broadcasters. The techniques and mechanisms of the present invention recognize that broadcast media programs can be made more interactive and/or more suitable for the immediate viewing audience by modifying media broadcasts using real-time feedback. For example, responses and viewing information can be used to customize programming, tailor advertising content, create target product promotions, revise content streams, recommend additional content, etc. Furthermore, user devices used to view the broadcast and provide responses can also supply additional information about the viewers and their respective devices, such as geographical location of the viewers, duration of viewing, channel change frequency, demographic information, device capabilities, etc.

Certain user devices provide a unique opportunity to implement techniques and mechanisms described herein due to their ability to receive and process unidirectional broadcast signal from broadcasting transmitters and provide two-way communication over other wired or wireless networks, such as cellular networks. Therefore, inability to provide a feedback over the conventional airwave broadcast is overcome by using different communication modality on the same device. More specifically, such user devices allow the integration of multiple communication modalities while providing a unified experience to the user. In certain embodiments, broadcast is provided through a bi-directional network, such as the Internet. In such embodiments, both media broadcast and user responses may be transmitted through the same network or communication medium. For example, Internet TV broadcast and user responses can both be transmitted to a mobile phone through a cellular network.

User devices connected to the Internet through various wired and/or wireless networks also provide opportunity to collect responses from multiple device users and process these responses in a collective fashion. User devices may be supported by different cellular networks and carriers and receive video streams from a variety of content providers and transmit responses to a designated server. The server then aggregates the responses and other available information according to various algorithms and generates reports for various parties (e.g., content providers, services providers, etc.).

According to various embodiments, a response processing server collects user responses from multiple user devices over a cellular network, such as a 3G network. Examples of cellular networks include, but not limited to TDMA Single-Carrier, CDMA Multi-Carrier, CDMA Direct Spread, CDMA TDD, FDMA/TDMA, and IP-OFDMA. Cellular networks may be supported by different cell phone providers. In a specific example, at least two of the cellular networks that are used to collect user responses are supported by different cellular network providers. More generally, any network that allows two-way wired and/or wireless transmission to user devices may be used for collecting user responses, such as Wi-Fi, Muni Wi-Fi, General packet radio service (GPRS), iBurst, WiBro/WiMAX, Universal Mobile Telecommunications System-Time-Division Duplexing (UMTS-TDD), High Speed Packet Access (HSPA), Evolution-Data Optimized (EVDO), Long Term Evolution (LTE), satellite, and many others.

The user responses correspond to the request, such as polls and surveys, transmitted as a part of a media broadcast to multiple user devices. These devices were tuned to a specific broadcasting channel during transmission of the request and displayed information corresponding to the request on the user interfaces of the user devices, such as touch screens. In particular embodiments, the broadcast transmission to the user devices is based on a mobile digital TV transmission protocol and technologies, such as Advanced Television Systems Committee-Mobile/Handheld (ATSC-M/H) protocol, Terrestrial Digital Multimedia Broadcasting (T-DMB), Digital Video Broadcasting-Handheld (DVB-H), etc.

In particular embodiments, a response processing server is configured to collect other information, such as demographic information, channel change frequency, and device capability information from the user devices that may not be a part of responses.

The user responses are then processed based on a set of criteria. For example, a statistical analysis may be performed to evaluate certain aspects of the responses (e.g., totals, distribution, correlations, etc.). Processing may involve waiting for a predetermined duration after the transmission of the request, aggregating data provided in the user responses received during that duration, and filtering the data based on a set of predetermined factors. A report is then generated based on the user responses and, in particular embodiments, transmitted to the broadcasting service, such as a content provider or a service provider. In particular embodiments, multiple reports are transmitted to the broadcasting service each containing an intermediate report generated based on the sub-set of the user responses. For example, a broadcasting service may want to show response results as soon as a representative pool is available and update the results as more user responses are collected and processed.

According to various embodiments, a content provider may interrupt current programming with a live broadcast of a major news event if viewer responses indicate that most viewers would want the current programming interrupted. In another example, a service provider may interrupt a live broadcast of a first sports event with a second sports event if viewers indicate that the first sports event is non-competitive or boring. In yet another embodiment, a service provider recognizes that nearly all viewers of a particular broadcast have particular device capabilities from user response information and may transmit a higher or lower quality stream based on the particular device capabilities.

According to particular embodiments, the broadcasting service uses this report to generate a report broadcast for transmission to the user devices. For example, the service may integrate a report pane into the channel content that shows results of the survey (e.g., a total number of viewers voted for a particular performer). In the same or other embodiments, the entire broadcasting content may be dynamically updated based on the information contained in the report. For example, the broadcasting service may integrate an additional video clip with the most favored performer or a commercial that is the most suitable for the identified viewer audience.

According to particular embodiments, a user device report is generated by, for example, a response processing server or any other processing facility based on the user responses and is transmitted over the cellular network to a subset of the user devices. For example, after responding to the request a number of viewers may change their TV channels. Yet, some of these users may be still interested in the response results. User devices may be configured to register various inputs that trigger a user's request for a user device report. This request may be sent to the response processing server to prepare a user device report and transmit this report back to user devices that have sent such requests. According to particular embodiments, the user device report is in the form of a text message, an e-mail, a voice mail, provided on the display itself, or integrated with the broadcast transmission by an application on the user device, etc.

FIG. 1 is a diagrammatic representation showing one example of an overall network system 100 that can be used to implement various embodiments of techniques and mechanisms described below. As illustrated, the system 100 may include wired or wireless two-way communication networks (e.g., cellular networks 111 and 112), computer networks (e.g., Internet 123), media broadcasting networks (e.g., broadcasting stations 141 and 142), and other types of communication networks. Communication streams through these networks among various elements of the system 100 are shown with leading lines.

According to particular embodiments, the system 100 includes multiple user devices 101-104 that are configured to receive media broadcasting signals from one or more one-way broadcasting transmitters 141-142 and to communicate through two-way wired and/or wireless networks, such cellular networks, Wi-Fi networks, etc. Examples of the user devices 101-104 include various mobile devices, such as cell phones, personal digital assistants (PDA), media players, as well as personal computers, servers, TV set-up boxes, and other devices. Certain hardware aspects of the user devices 101-104 are described in the context of FIG. 4. Software aspects are further covered in the context of FIG. 5.

In particular embodiments, the user devices 101-104 are configured to receive TV broadcast signals from the transmitters 141-142. Broadcast data may include real-time audio and video streams, individual, non-real-time video and audio streams, etc. For the purposes of this document, a transmitter is any device that is used to deliver broadcasting signals from the broadcasting center 131 to the user devices 101-104, such as transmitters, repeaters, gap-fillers, and satellites. The transmitters 141-142 may use various technologies and protocols, listed above, to deliver the signal to the user devices.

According to particular embodiments, the broadcasting service 131 prepares media content that is converted into radio frequency signals supplied by the transmitters 141-142. The user devices 101-104 are configured to decode the received signal to display one or more channels on their user interfaces. The broadcasting service 131 typically has a content provider links as well as a content database. As shown in FIG. 1, the broadcasting service 131 is interconnected with the response processing server 121, which may provide some content and/or information that would guide the broadcasting service 131 in generating content.

User devices 101-104 are also configured to deliver responses to the response processing server 121 over wired and/or wireless two-way communication networks, such as cellular networks 111-112. Other types of networks are described above. For example, a request sent to the user devices 101-104 may include an IP address of the response processing server 121. After a user responds to the request, a user device automatically generates and sends a message including the users response to that IP address. In particular embodiments, other information described above may be sent from the user devices 101-104 to the response processing server 120, which provides richer context to the user responses (e.g., geographic location). Information may also be included in the response to link the particular response with user activity and viewing information at the time the response was generated.

As shown, the response processing server 121 may receive data from multiple user devices 101-14 operating in different cellular networks 111 and 112, which may be using different data transmission protocols supported by different cell phone providers (e.g., AT&T, Verizon, etc.). Examples of the cellular network data transmission protocols include TDMA Single-Carrier, CDMA Multi-Carrier, CDMA Direct Spread, CDMA TDD, FDMA/TDMA, and IP-OFDMA, etc.

The response processing server 121 then processes the responses and generates one or more reports, some of which may be delivered to the broadcasting center 131. The broadcast service 131 may use information contained in the reports to supplement and/or modify its broadcasting content, which is briefly explained in the context of FIGS. 2A and 2B.

Figure 2A:
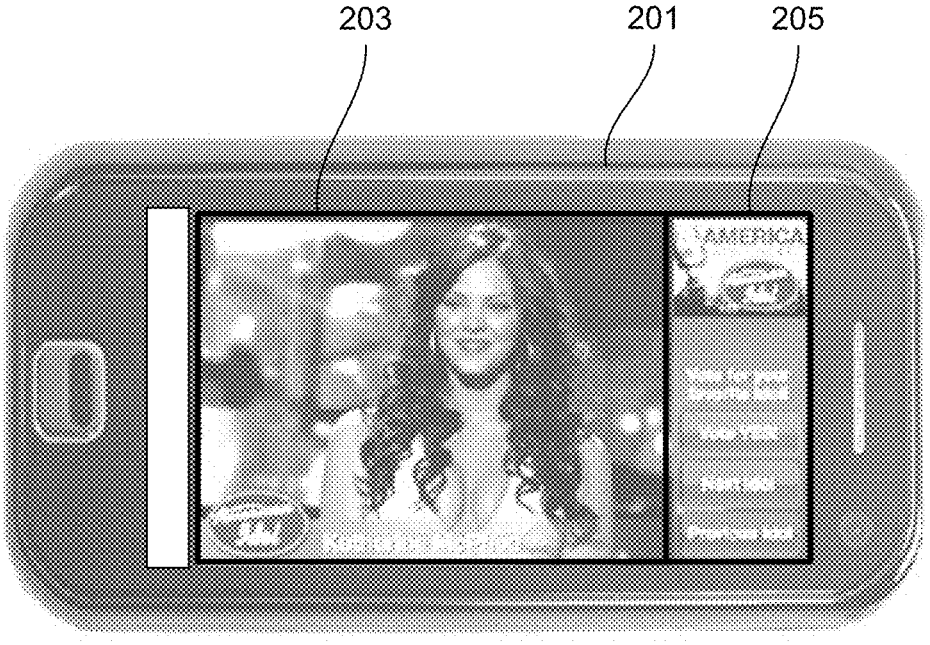
FIG. 2A illustrates a user device displaying a media broadcast with a request pane in accordance with particular embodiments.

FIG. 2A illustrates a user device 201 displaying a content of the media broadcast that includes a request pane 205. The content is displayed on the user interface 203 of the user device 201, which may be a touch screen or any other forms of data output. The request pane 205 presents a question and a series of answers to the viewers to select (e.g., a survey). The selection may be performed by using certain inputs of the user devices (e.g., pressing designates areas on the touch screen). It should be understood that various presentations and layouts of the request pane are possible (e.g., different portions and arrangements on the screen, association with various inputs of the user devices, etc.).

In particular embodiments, a request is provided to user devices through a communication stream or channel that is different from the media broadcast and then integrated together with the media broadcast on user interfaces of the user devices. For example, a survey may be transmitted to user devices using a cellular broadband network. In certain specific embodiments, a device sending the request is configured to identify a set of user devices that are tuned to a specific broadcasting channel (e.g., user devices send a message to a server when switching to a particular broadcast channel and these messages are used to identify the devices). Once identification is completed, only the devices tuned to a particular channel receive the corresponding request. In some embodiments, the communication channel may be used for transmitting requests and responses and, in particular embodiments, transmitting media content. In other embodiments, one or all communication channels are different. For example, media broadcast may be transmitted through one channel, a request—through another channel, and a response—through yet another channel.

In particular embodiments, information corresponding to the request is displayed for a predetermined duration that allows viewers (i.e., device users) to respond to the request. For example, the duration may range from 3 and 15 seconds or 5 to 10 seconds. In particular embodiments, the duration may be dynamically adjusted by the broadcasting center 131 based on certain factors (e.g., a number of responses received at the response processing server, information contained in the responses) Longer durations may be less favorable from a viewers' perspective. In particular embodiments, viewers may be restricted to perform additional operations related to broadcast viewing (e.g., changing a channel or continue to view the current channel) until the viewers provide their responses. Such approach is also sometimes referred to as a "barker" screen. Furthermore, in particular embodiments, the request pane 205 is dynamically updated with, for example, intermediate results of the survey or other information.

Figure 2B:
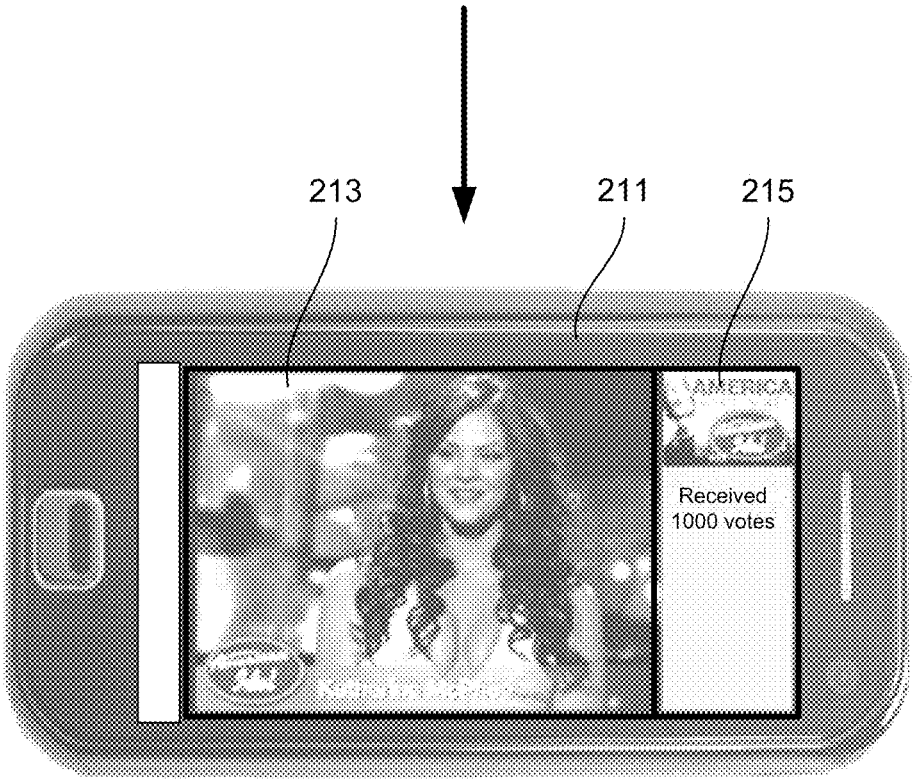
FIG. 2B illustrates a user device displaying a media broadcast with a result pane in accordance with particular embodiments.

Upon receiving responses from the user devices, the response processing server processes information contained in the responses and generates a report, which may be sent to the broadcasting service. The broadcasting service, in turn, updates the broadcast based on the information included in the report. For example, the broadcast may include a result pane 215 as shown in FIG. 2B that is displayed on the user interface 213 of the user device 211.

Figure 3:
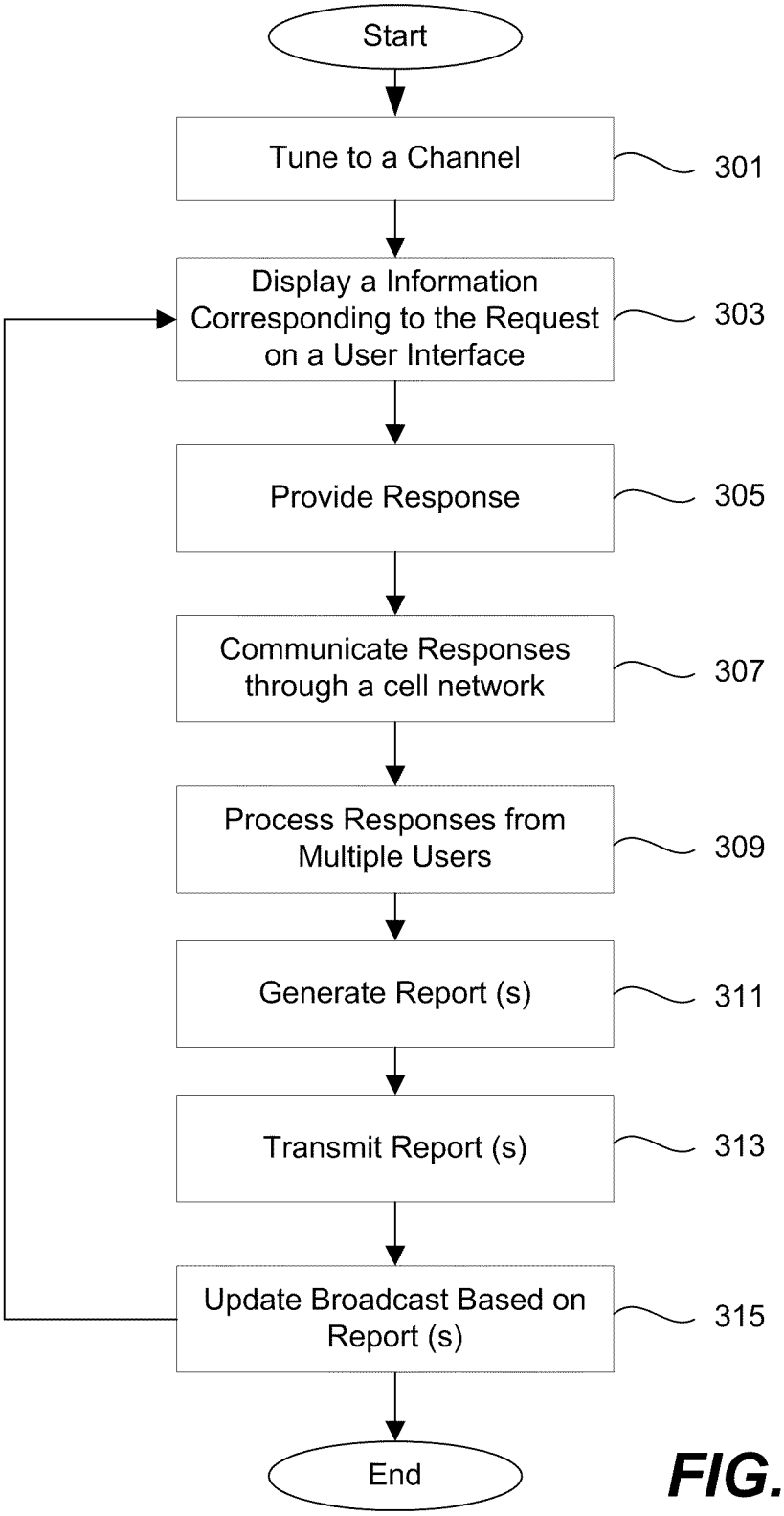
FIG. 3 illustrates a particular example of a technique for collecting and processing user responses.

FIG. 3 illustrates one example of a technique for collecting user responses and integrating information from the responses into the broadcast message. At 301, a user tunes its user device to a specific broadcast channel. This may involve decoding a received broadcasting signal in such a way that a selected channel is displayed on the user interface of the user device. At a certain time, the broadcasting service integrates a request into the broadcasted content corresponding to this channel and, as a result, the request is displayed on the user interface (block 303).

A user may choose to respond to the request (block 305) by providing input using one or more input functions of the user device (e.g., pressing a designated area in the touch screen, pressing a button, speaking a voice command, etc.). In particular embodiments further described above, the users may be restricted from using use other functionalities of their user devices until they respond to the request. It should be noted that no actions from users or user switching to another channel during the request period (i.e., a predetermined duration during which the request is a part of the broadcast content) may be also considered as response information as they contain certain valuable insights into user activity (e.g., switching to another channel). It should be also noted that a request in the context of this document could mean any forms and types of data collection from user device users where such data collection is initiated with a message provided to the user interface. For example, a request may take a form of an interactive game where the media broadcast is used to deliver a series of questions to the users in real time and soliciting responses to these questions to identify a winner.

Once an initial or entire response to the request is provided by the user in operation 305 the user device proceeds with communicating the response to the response processing server (block 307). Other information such as demographic and device information that may be available may also be sent in to the response processing server.

In particular embodiments, when a user may take longer to respond to the request than is allocated by the broadcasted content, the user device may send a "time-out" message to the response processing server and the server may reply with an option for the user to respond to the request outside of the request period identified by the broadcaster. In this situation, a replacement request may be sent to the identified user device by the response processing server itself.

Responses sent from the user devices are then processed by the response processing server (block 309). Processing may be performed upon receiving each new response, upon receiving a predetermined number of the responses, after a predetermined period of time, or according to any other scheme. Often, the server processes responses in multiple batches in order to provide intermediate results to interested parties. For example, the broadcasting service may receive intermediate result and update the broadcast content with the "up-to-date" results while additional responses are being collected and processed by the server. Such scheme (i.e., broadcasting intermediate results) may encourage additional viewers to respond.

Processing of the responses (block 309) may involve integrating responses from multiple users (e.g., summing up the votes), comparing responses to the correct answers (e.g., trivia games), eliminating responses that are deemed "wrong" (e.g., inconsistent with other responses or available information), fitting data (e.g., eliminating outliers), performing various statistical analysis (e.g., calculating averages, standard deviations, etc.).

According to various embodiments, a response processing server generates one or more reports (block 311) based on the user responses and other information available to the server. Different reports may be generated for various users. In particular examples, a comprehensive report is generated for a broadcasting service provider. At the same time, a more condensed report in the form of a simple e-mail or a text message may be generated for viewers that switched to different channels but still interesting in being informed about the results.

The reports are then transmitted to various entities (block 313), such as content providers, services providers, device users, etc. As mentioned above, content and service providers may modify unidirectional media broadcasts in real-time based on user feedback (block 315). The process involving operations 303-315 may be repeated multiple times to gather additional information from the viewers and updating the broadcasted content.

Figure 4:
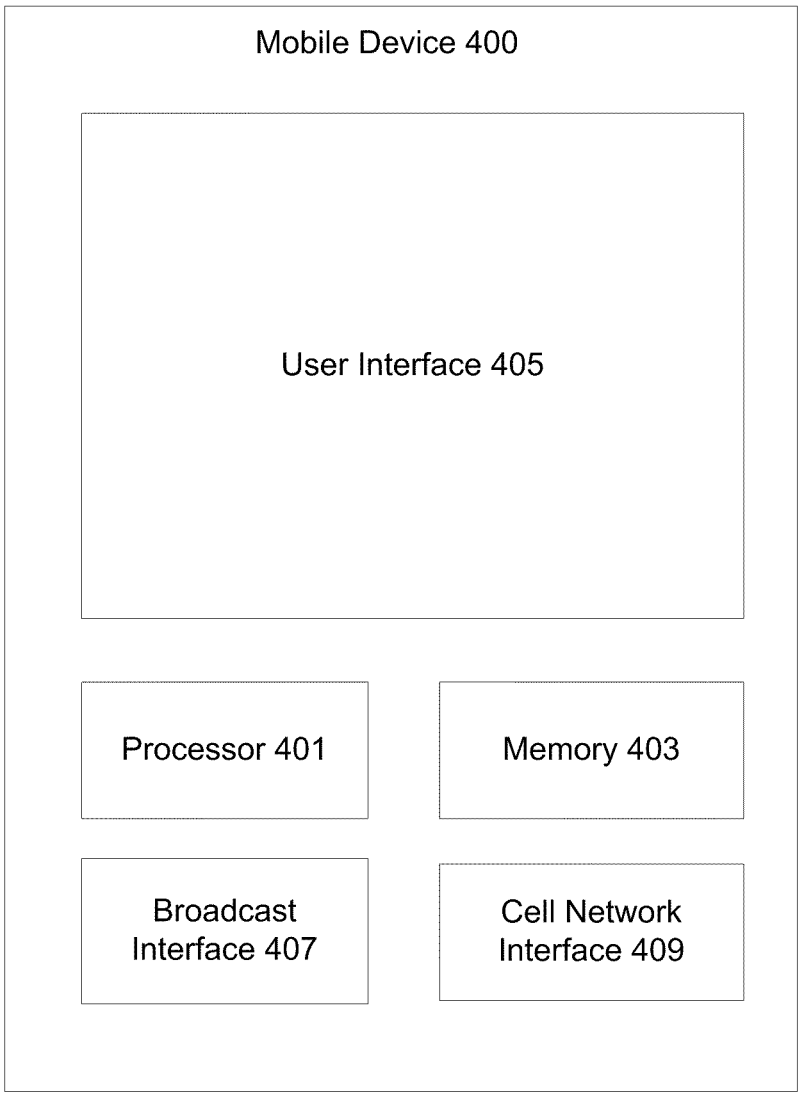
FIG. 4 illustrates a particular example of a user device.

FIG. 4 illustrates a particular example of a user device 400. The user device 400 includes a processor 401, a memory 403, a user interface 405, a broadcast interface 407, a cellular network interface 409, and a power source. The broadcast interface 407 may receive unidirectional media broadcasts transmitted using a variety of modalities such as over the air broadcasts, packet based unidirectional broadcasts, tower based unidirectional broadcasts, etc. Unlike conventional cell phones, user devices that are used to implement various embodiments of techniques and mechanisms described in this document have special requirements associated with receiving and processing broadcast signals, communicating information to servers, and perform other functions. For example, a processor 401 may be configured to provide high definition TV resolution on the user interface 405. An example of such processing is a DMS-02 chip available for 3DLabs in Milpitas, Calif. that is capable of 720 pixels resolution AVC/H.264 video playback. A user interface 405, such as an LCD screen, should be able to support the translated content (e.g., an adequate screen resolution). The memory 403 may need to support the high buffer requirements of mobile TV as well as advanced software application for processing broadcast signals. Furthermore, advanced processing, communicating, and displaying capabilities of these user devices and more frequent use of these capabilities require substantial power outputs provided by the power source.

Figure 5:
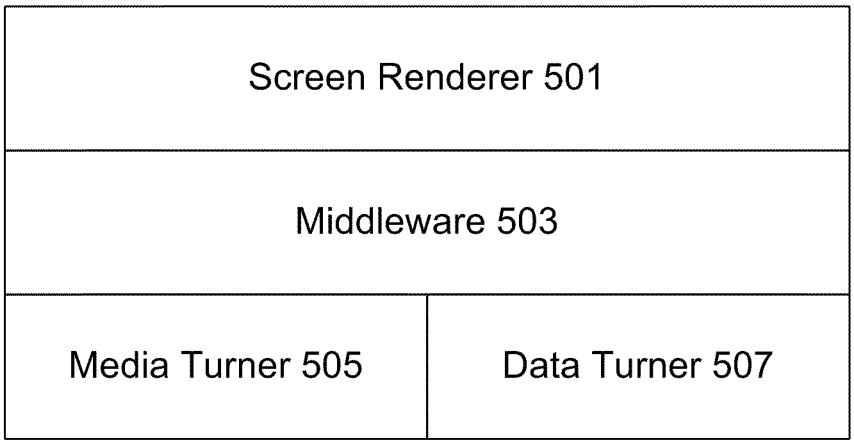
FIG. 5 illustrates a particular example of a software stack on a user device.

FIG. 5 illustrates one example of a software architecture stack, which can be implemented on the user devices described above. In particular embodiments, a media tuner 505 and a data tuner 507 may be used. A media tuner 505 is used to process media data provided in the unidirectional broadcasted signal. The media tuner 505 decodes the signal to retrieve media data corresponding to a particular channel to which the user device is currently tuned to. A data tuner 507 is used to process bi-directional data stream, e.g., a cellular network communication signal. A middleware layer 503 may be positioned between a screen rendered 501 and the media tuner 505 and the data tuner 507. The middleware 503 is used to integrate unidirectional broadcasted signals processed by the media tuner 505 with bi-directional data streams processed by the data tuner 507 to provide inputs to the user interface of the user devices and process various outputs. Such integration may involve processing and displaying inputs of the two communication streams, processing outputs provided by a user on the user interface, and directing information corresponding to these outputs to the data tuner 507, and other functions. For example, a media tuner 505 may receive a signal containing a request as well as other media content. A media tuner 505 processes the signal and passes it to the middleware 503. The middleware 503 then instructs the screen render 501 when and whether to display information contained in the request (e.g., a survey) based on inputs provided by the user (e.g., channel selection, using other functions of the user devices). Once the information contained in the request is displayed and the user's response is received, the middleware 503 processes the response and instructs the data tuner 507 to send information corresponding to the response to a designated recipient (e.g., a response processing server).

Figure 6:
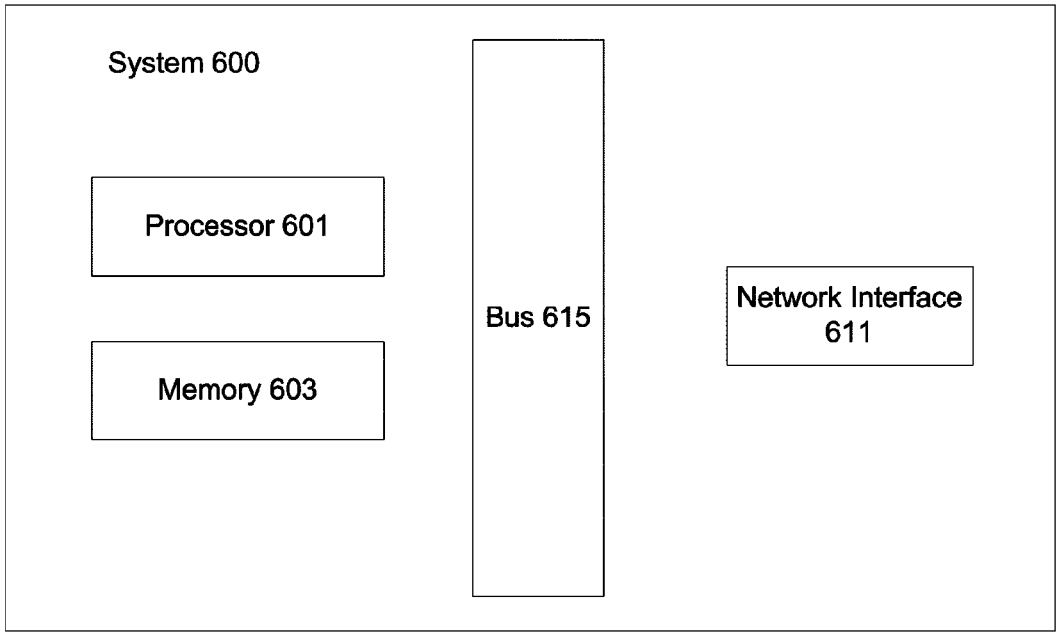
FIG. 6 illustrates a particular example of a response processing server.

FIG. 6 illustrates one example of a server that can be used to evaluate user response. According to particular embodiments, the server 600 suitable for various embodiments of techniques and mechanisms described in this document includes a processor 601, a memory 603, an interface 611, and a bus 615 (e.g., a PCI bus or other interconnection fabric) and operates as a streaming server. When acting under the control of appropriate software or firmware, the processor 601 is responsible for collecting and processing user response and generating and transmitting reports based on these responses. Various specially configured devices can also be used in place of a processor 601 or in addition to processor 601. The interface 611 is typically configured to end and receive data packets or data segments over a network.

Particular examples of interfaces supports include Ethernet interfaces, frame relay interfaces, cable interfaces, DSL interfaces, token ring interfaces, and the like. In addition, various very high-speed interfaces may be provided such as fast Ethernet interfaces, Gigabit Ethernet interfaces, ATM interfaces, HSSI interfaces, POS interfaces, FDDI interfaces and the like. Generally, these interfaces may include ports appropriate for communication with the appropriate media. In some cases, they may also include an independent processor and, in some instances, volatile RAM. The independent processors may control such communications intensive tasks as packet switching, media control and management.

Because such information and program instructions may be employed to implement the systems/methods described herein, the present invention relates to tangible, machine readable media that include program instructions, state information, etc. for performing various operations described herein. Examples of machine-readable media include hard disks, floppy disks, magnetic tape, optical media such as CD-ROM disks and DVDs; magneto-optical media such as optical disks, and hardware devices that are specially configured to store and perform program instructions, such as read-only memory devices (ROM) and programmable read-only memory devices (PROMs). Examples of program instructions include both machine code, such as produced by a compiler, and files containing higher level code that may be executed by the computer using an interpreter.

While the invention has been particularly shown and described with reference to specific embodiments thereof, it will be understood by those skilled in the art that changes in the form and details of the disclosed embodiments may be made without departing from the spirit or scope of the invention. It is therefore intended that the invention be interpreted to include all variations and equivalents that fall within the true spirit and scope of the present invention.

What is claimed is:

1. A method, comprising:

collecting real-time user response information at a response processing server from a plurality of user devices over a cellular network, wherein the real-time user response information corresponds to a request transmitted within a communication channel used to broadcast both a first media stream and the request to the plurality of user devices tuned to a unidirectional broadcast channel provided by a broadcasting service, wherein the request is a request for a user response transmitted to a user device, wherein the request includes a survey, a question to a user, or instructions to the user to provide feedback;

processing the real-time user response information based on a predetermined set of criteria;

generating a report based on the real-time user response information; and transmitting the report to the broadcasting service over a network in order to dynamically update content in the media stream based upon the report, wherein the broadcasting services interrupts the first media stream transmitted on the unidirectional broadcast channel with a second media stream transmitted on the unidirectional broadcast channel based on the report and aggregated user response information.

2. The method of claim 1, wherein the report is used by the broadcasting service to modify the media broadcast transmitted to the plurality of user devices.

3. The method of claim 1, wherein the request is transmitted from the broadcast service to the plurality of user devices using a mobile digital TV transmission protocol.

4. The method of claim 3, wherein the mobile digital TV transmission protocol is Advanced Television Systems Committee-Mobile/Handheld (ATSC-M/H) protocol.

5. The method of claim 1, wherein the cellular network is a 3G network.

6. The method of claim 1, wherein the user response information is collected over a plurality of cellular networks utilizing one or more of standards selected from the group consisting of TDMA Single Carrier, CDMA Multi Carrier, CDMA Direct Spread, CDMA TDD, FDMA/TDMA, and IP OFDMA.

7. The method of claim 1, wherein information corresponding to the request is displayed on user interfaces of the plurality of user devices tuned to a predetermined TV channel.

8. The method of claim 1, wherein the request is transmitted as a part of the media broadcast for a predetermined duration.

9. The method of claim 8, wherein the predetermined duration is between about 3 and 15 seconds.

10. The method of claim 1, wherein the processing of the user response information comprises:

waiting for a predetermined period of time after the transmission of the request;

aggregating data provided in the user response information received during the predetermined period of time; and filtering the data based on a predetermined factor.

11. The method of claim 1, wherein the transmission of the report to the broadcasting service comprises a plurality of transmissions each containing an intermediate report generated based on a sub-set of the user responses collected at the response processing server.

12. The method of claim 1, further comprising:

generating a user device report based on the user response information; and transmitting the user device report to a subset of the plurality of user devices over the cellular network.

13. The method of claim 12, wherein the user device report is in one or more of forms selected from the group consisting of a text message, an e-mail, and a voice mail.

14. The method of claim 12, wherein the subset of the plurality of user devices comprises devices tuned away the broadcast channel used to transmit the request before the report is transmitted to the broadcasting service.

15. The method of claim 1, wherein the user response information further comprises user demographic information.

16. The method of claim 1, wherein the user response information further comprises user device information.

17. The method of claim 1, wherein the user response information further comprises user's current geographic location.

18. The method of claim 1, the broadcasting service is a content provider.

19. The method of claim 1, the broadcasting service is a service provider.

20. An apparatus comprising:

an input interface operable to collect real-time user response information from a plurality of user devices over a cellular network, wherein the real-time user response information corresponds to a request transmitted within a communication channel used to broadcast both a first media stream and the request to the plurality of user devices tuned to a unidirectional broadcast channel provided by a broadcasting service, wherein the request is a request for a user response transmitted to a user device, wherein the request includes a survey, a question to a user, or instructions to the user to provide feedback;

a processor operable to process the real-time user response information based on a predetermined set of criteria and to generate a report based on the real-time user response information; and an output interface operable to transmit the report to the broadcasting service over a network in order to dynamically update content in the media stream based upon the report, wherein the broadcasting services interrupts the first media stream transmitted on the unidirectional broadcast channel with a second media stream transmitted on the unidirectional broadcast channel based on the report and aggregated user response information.

21. A device, comprising:

means for collecting real-time user response information at a response processing server from a plurality of user devices over a cellular network, wherein the real-time user response information corresponds to a request transmitted within a communication channel used to broadcast both a first media stream and the request to the plurality of user devices tuned to a unidirectional broadcast channel provided by a broadcasting service, wherein the request is a request for a user response transmitted to a user device, wherein the request includes a survey, a question to a user, or instructions to the user to provide feedback;

means for processing the real-time user response information based on a predetermined set of criteria;

means for generating a report based on the real-time user response information; and means for transmitting the report to the broadcasting service over a network in order to dynamically update content in the media stream based upon the report, wherein the broadcasting services interrupts the first media stream transmitted on the unidirectional broadcast channel with a second media stream transmitted on the unidirectional broadcast channel based on the report and aggregated user response information.

* * * * *